United States Patent [19]

Harada et al.

[11] 4,168,481

[45] Sep. 18, 1979

[54] CORE ASSEMBLY FOR MAGNETIZING COLUMNAR PERMANENT MAGNET FOR USE IN AN ELECTROSTATIC DEVELOPING APPARATUS

[75] Inventors: Hideki Harada, Urawa; Keitaro Yamashita, Kamisatomachi; Katsunobu Yamamoto, Kumagaya, all of Japan

[73] Assignee: Hitachi Metals, Ltd., Tokyo, Japan

[21] Appl. No.: 839,446

[22] Filed: Oct. 5, 1977

[51] Int. Cl.[2] ..... H01F 13/00

[52] U.S. Cl. ..... 335/284; 118/658; 361/143

[58] Field of Search ..... 335/284; 361/143; 118/658; 29/607

[56] References Cited

U.S. PATENT DOCUMENTS

| | | | |
|---|---|---|---|
| 3,158,797 | 11/1964 | Andrews | 335/284 |
| 3,402,698 | 5/1967 | Kojima et al. | 118/658 |
| 3,455,276 | 5/1967 | Anderson | 118/658 |
| 3,828,730 | 5/1972 | Yamashita et al. | 118/658 |
| 3,952,701 | 11/1974 | Yamashita et al. | 118/658 |

FOREIGN PATENT DOCUMENTS

| | | | |
|---|---|---|---|
| 5114800 | 7/1974 | Japan | 335/284 |

*Primary Examiner*—R. N. Envall, Jr.
*Attorney, Agent, or Firm*—Finnegan, Henderson, Farabow & Garrett

[57] ABSTRACT

A core assembly for magnetizing a columnar permanent magnet, especially a columnar ceramic permanent magnet, adapted for use in an electrostatic developing apparatus of magnetic-brush developing type. The magnetizing iron core assembly has a specific arrangement of magnetic poles and magnetizing coil windings for providing a specific pattern of magnetic flux distribution which would provide the most efficient development.

4 Claims, 8 Drawing Figures

CORE ASSEMBLY FOR MAGNETIZING COLUMNAR PERMANENT MAGNET FOR USE IN AN ELECTROSTATIC DEVELOPING APPARATUS

LIST OF PRIOR ART REFERENCES (37 CFR 1.56 (a))

The following references are cited to show the state of the art:

Japanese Utility Model Laid-Open No. Sho. 51-14800 Keitarou Yamashita et al July 22, 1974

U.S. Pat. No. 3,455,276 Glenn R. Anderson May 23, 1967

U.S. Pat. No. 3,402,698 Motoki Kojima et al May 26, 1967

U.S. Pat. No. 3,828,730 Keitarou Yamashita et al May 16, 1972

U.S. Pat. No. 3,952,701 Keitarou Yamashita et al Nov. 5, 1974.

BACKGROUND OF THE INVENTION

The present invention relates to an iron core assembly for magnetizing a magnet adapted for use in an electrostatic developing apparatus of magnetic-brush developing type. More particularly, the invention is concerned with an iron core assembly adapted for producing a plurality of axially extending magnetic poles on the cylindrical surface of a columnar magnet which is generally referred to as a magnetic roll.

Developers conventionally used for developing latent images on an electrostatic latent image carrier such as a photoconductive body are classified into bi-components developer consisting of two components of magnetic carrier and toner particles, and uni-component developer in which magnetic particles are incorporated in the toner particles.

Also, the developing methods are generally classified into cascade type and magnetic brush type. In the past, the cascade type developing method had been widely used. However, due to the so-called edge effect or fringing effect, which disadvantageously causes an insufficient developing at the central portion of the region to be developed, and due to other disadvantages inherent in the cascade type method, the magnetic brush type developing method has been getting popular in recent years.

In the developing apparatus of the magnetic brush type, the developer particles are conveyed to the region of a latent image on a carrier, in accordance with the rotation of a developing roll. The developer particles then protrudes in a brush-like form, in the area close to the electrostatic latent image, by the attracting force caused by a permanent magnet incorporated in the developing roll. The developer particles are deposited on the latent image to render the latter visible, as the image is rubbed by the brush-like mass of developing particles, as a result of the rotation of the developing roll or of the movement of the image itself.

The developing roll used for this purpose may be a columnar magnet consisting of, as shown in the specification of Anderson's U.S. Pat. No. 3,455,276, a plurality of previously magnetized sector shaped rubber permanent magnets secured around a rotary shaft, or may be one constituted by block-shaped permanent magnets as disclosed in the specification of U.S. Pat. No. 3,402,698 of Kojima et al.

It has been well-known, however, to those skilled in the art that when the permanent magnet is to be incorporated in the developing roll it is preferable that an integrally formed ceramic permanent magnet be used. Clearly, the axially extending integral columnar magnet can provide an uniform distribution of the magnetic flux on the side line of the magnet, when magnetized, because it has no seam of magnet pieces on the magnetic poles. The use of such a developing roll as incorporating an integral ceramic permanent magnet has been disclosed in the specification of U.S. Pat. No. 3,828,730 of Yamashita et al, and also in the specification of U.S. Pat. No. 3,952,701.

It is extremely difficult to magnetize the ceramic magnet piece formed integrally. Only Japanese Utility Model Laid-open Publication No. 51-14,800 (Published on Feb. 3, 1976) is concerned with this magnetization of the integral ceramic magnet piece. However, this Publication fails to disclose the practical measure for effecting the magnetization.

Ever since, the present inventors have worked out a magnetizing means capable of practically producing a complicated magnetic pole pattern on a columnar magnet piece.

It is therefore a principal object of the invention to provide magnetizing means capable of magnetizing a columnar permanent magnet so that the latter may have a magnetic pole pattern which would diminish the deterioration of the developer.

To this end, according to the invention, there is provided an iron core assembly for magnetizing a columnar permanent magnet for use in an electrostatic developing apparatus, comprising: a plurality of axially extending magnetic poles, said poles circumferentially disposed so that the inner surfaces of the poles form a through-bore for receiving a magnet to be magnetized and are adapted to be arranged in close proximity of the outer surface of the magnet when it is disposed in the through bore; and coil winding for magnetizing said magnetic poles, the winding surrounding each of the magnetic poles and disposed in a groove formed between said poles, wherein the circumferential breadth of the magnetic pole is much smaller than that of the grooves and the coil windings are concentrated around the magnetic poles.

The above and other objects, as well as advantageous features of the invention will become clear from the following description of preferred embodiment taken in conjunction with the attached drawings in which:

BRIEF DESCRIPTION OF THE INVENTION

FIG. 1 is a longitudinal sectional view of a developing roll incorporating a columnar permanent magnet magnetized by means of a magnetizing iron core assembly embodying the present invention, FIGS. 2 and 3 are sectional views of essential parts of an electrostatic developing apparatus having a developing roll incorporating the columnar permanent magnet magnetized by means of the iron core assembly in accordance with the invention, FIG. 4 is a perspective view of an iron core assembly embodying the present invention, FIGS. 5 and 6 are cross-sectionally enlarged views of essential parts of the iron core assembly embodying the invention, and FIGS. 7 and 8 are graphical representations of magnetic flux distribution in the iron core assembly in accordance with the invention.

DESCRIPTION OF THE PREFERRED EMBODIMENTS

Figure 1:
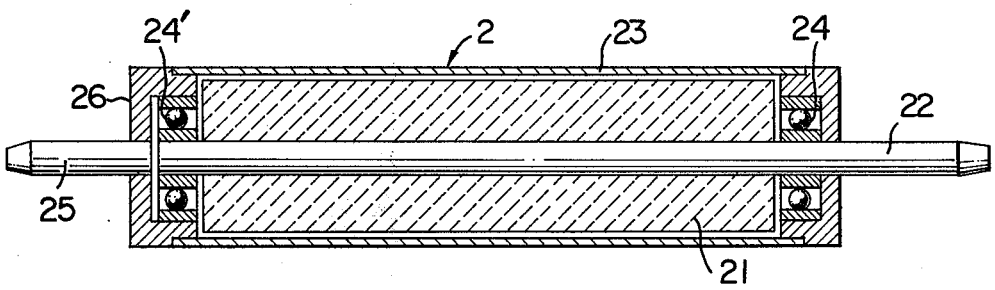
Figure 2:
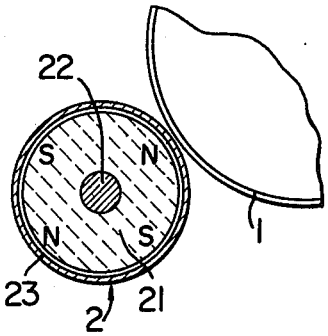
Figure 3:
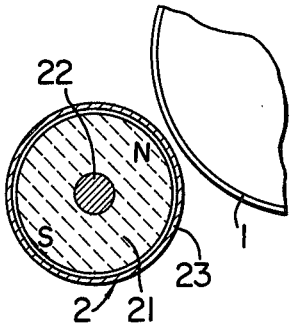

Referring at first to FIGS. 1 through 3, an electrostatic developing apparatus is shown, wherein a photosensitive body 1 carrying an electrostatic latent image is arranged opposite to a developing roll 2 in a juxtaposed relation. The developing roll 2 has a columnar ceramic permanent magnet 21 which is fixedly carried by a rotary shaft 22.

A cylindrical shell 23 made of a non-magnetic material such as aluminum, plastics or the like is disposed so as to coaxially surround the permanent magnet 21. The shell 23 is rotatably supported by the rotary shaft 22, through bearings 24, 24' and is unitarily secured to another rotary shaft 25 through a side wall 26.

Assuming that the rotary shaft 22 is kept stationary, the permanent magnet 21 is also kept unrotated, but the shell 23 is allowed to rotate along with the rotary shaft 25.

The columnar permanent magnet 21 of the developing roll 2 is provided on its periphery with a plurality of magnetic poles extending in the axial direction thereof.

In general, magnetic developer material is an admixture of magnetic carrier and toner, and the toner sticks to the surface of the carrier due to an electric charge electrostatically formed thereon. The developer material is attracted to the developing roll 2 and is conveyed, in accordance with the rotation of the outer non-magnetic shell 23, to a developing zone where the developing roll 2 confronts the photo-sensitive body holding an electrostatic latent image. The developer material is brought to the developing zone, and then swells to assume a brush-like form. The brush-like developer material then rubs the electrostatic latent image, so that the toner particles in the developer material are transferred to the latent image to render the latter visible.

The toner is gradually consumed as the developer material is used repeatedly and, therefore, is supplemented as necessitated. However, the carrier is worn due to the repeated use, suffering from the dropping of the resinous surface portion thereof and other damages.

Hereinafter, a description will be made as to an improved developing roll capable of eliminating the fatigue of the carrier, and a novel magnetizing means for magnetizing such a developing roll.

Figure 4:
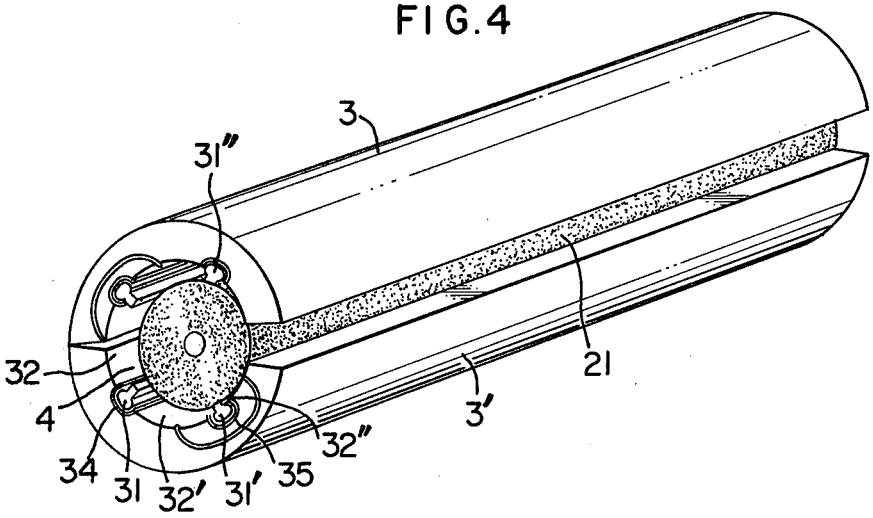

As will be seen from FIG. 4, a magnetizing iron core assembly of the invention is split into two halves or iron core segments 3, 3' which, when coupled with each other, define a through-bore 4 of such a size as can scarcely receive a columnar permanent magnet material 21 to be magnetized. Thus, the iron core assembly is split along a plane which passes through the longitudinal axis of the columnar magnet material 21 disposed therein. Protrusions 31, 31' . . . are formed on the wall of the through-bore 4 to project therefrom radially inwardly, so as to form magnetic poles of a magnetizing yoke. Grooves 32, 32', 32'' . . . formed between adjacent protrusions 31, 31' . . . , i.e. between the magnetic poles, receive magnetizing coil windings 34, 35. More specifically, the coil winding 34 is wound around the magnetic pole 31, while another coil winding 35 goes round the magnetic pole 31'. Each groove further receives, at its central bottom portion, at least one coil winding 36 in such a manner the electric current through the coil winding 36 runs in the same direction as those through other windings received by the same groove.

Figure 5:
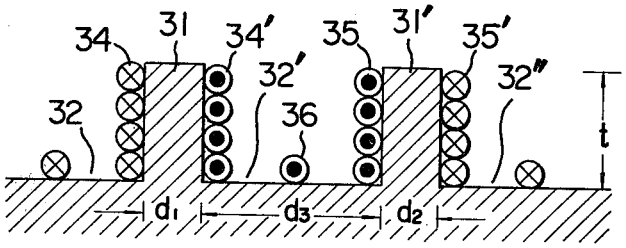
Figure 7:
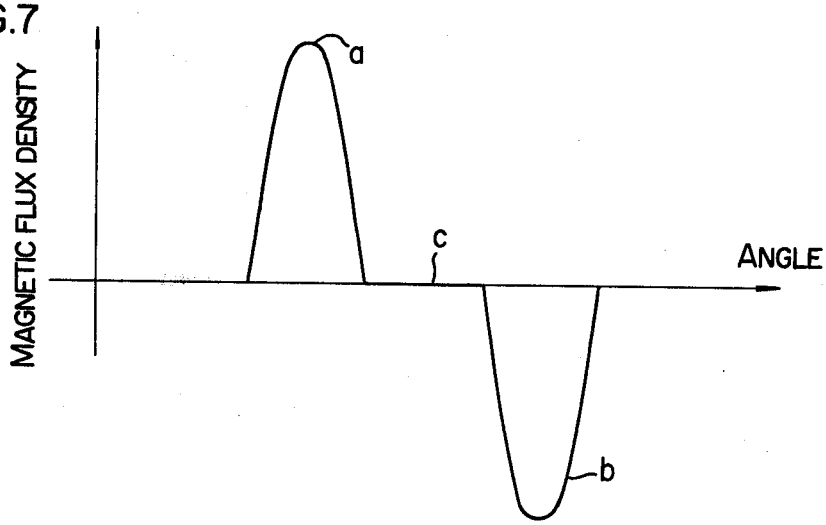

To confirm the advantage of the invention, a magnetizing iron core assembly of the invention was prepared to have the circumferential breadth of magnetic poles of 4 mm, the circumferential breadth of the groove of 8 mm and the depth of the groove of 8 mm, for magnetizing a ceramic columnar permanent magnet material having a diameter and length of 34 mm and 280 mm, respectively. The number of turns of coil windings 34 and 35 was selected to be 5, while the coil winding 36 made 1 (one) turn. A magnetizing current of D.C. 3000 A was applied through the coil windings of the magnetizing yoke, in the direction as shown in FIG. 5, so as to magnetize the ceramic columnar permanent magnet material. Consequently, a magnetic flux distribution as shown in FIG. 7 was obtained along the peripheral line of the permanent magnet. It will be seen that the peaks a and b correspond to respective magnetic poles 31, 31', while the non-magnetized portion C corresponds to the groove 32'.

It is remarkable that the deterioration of the magnetic particles is greatly reduced, when an admixture of magnetic particles and toner is used in combination with a magnet magnetized in the described manner. It is considered that such a great reduction of the fatigue of magnetic particles is due to an eased or relieved gradient of polarity inversion on the magnet, from N to S and vice versa, since there is provided the non-magnetized portion C so as to effectively moderate an abrupt polarity inversion of the particle.

Figure 6:
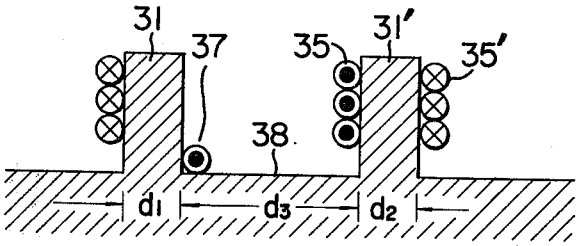
Figure 8:
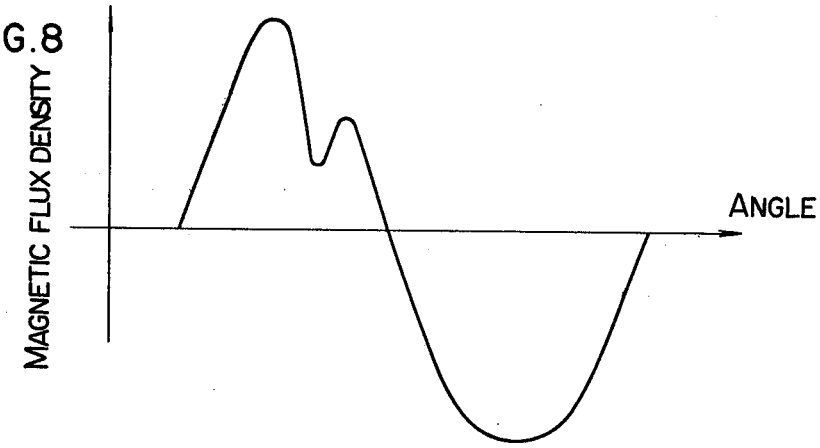

FIG. 8 shows the magnetic flux density of another embodiment of the invention in which some of the magnetic poles are intentionally weakened. The magnetizing iron core assembly of this embodiment incorporates a magnetizing yoke as shown in FIG. 6. More specifically, some of the magnetic poles exemplarily represented by the pole 31 has, at its one side, a coil winding 37 located close to the bottom of the groove, so that a part of magnetic flux produced by the magnetic pole 31 is allowed to leak to the bottom of the groove 38.

Consequently, as will be seen from FIG. 8, the magnetic flux distribution curve for the magnetic pole 31' is flattened, due to the presence of two peaks, as compared with that for the magnetic pole 31. It will be seen that the abrupt polarity inversion is relieved due to the flattening of the magnetic flux intensity, so as to provide the same effect as the foregoing embodiment.

What is claimed is:

1. A core assembly for magnetizing a columnar permanent magnet for use in an electrostatic developing apparatus comprising:

a plurality of axially extending magnetic poles, said poles being circumferentially disposed so that the inner surfaces of the poles partially define a through-hole for receiving a magnet to be magnetized and are adapted to be arranged in close proximity of the outer surface of the magnet when it is disposed therein; and coil windings for magnetizing the magnetic poles, each of said winding surrounding each of the magnetic poles and is disposed in a groove formed between the poles, wherein the width of said magnetic pole is much smaller than that of said groove and said coil windings are concentrated around the magnetic poles.

2. A core assembly for magnetizing a columnar permanent magnet for use in an electrostatic developing apparatus comprising:

a plurality of axially extending magnetic poles, said poles being circumferentially disposed so that the inner surfaces of the poles partially define a through-hole for receiving a magnet to be magnetized and are adapted to be arranged in close proximity to the outer surface of the magnet when it is disposed therein; and coil windings for magnetizing the magnetic poles, each of said windings surrounding each of the magnetic poles and being disposed in a groove formed between the poles, wherein the width of said magnetic pole is much smaller than that of said groove and said coil windings are concentrated around the magnetic poles, wherein at least one additional coil winding is received by said groove and positioned at the center of the bottom of said groove, said additional coil winding positioned at the center of the bottom groove being adapted to pass an electric current in the same direction as those running through other coil windings received by the same groove.

3. A core assembly for magnetizing a columnar permanent magnet for use in an electrostatic developing apparatus comprising:

a plurality of axially extending magnetic poles, said poles being circumferentially disposed so that the inner surfaces of the poles partially define a through-hole for receiving a magnet to be magnetized and are adapted to be arranged in close proximity to the outer surface of the magnet when it is disposed therein; and coil windings for magnetizing the magnetic poles, each of said winding surrounding each of the magnetic poles and being disposed in a groove formed between the poles, wherein the width of said magnetic pole is much smaller than that of said groove and said coil windings are concentrated around the magnetic poles, wherein a portion of the coil winding surrounding a magnetic pole is disposed at the corner of the bottom of one of the grooves beside the pole, so that the magnetic pole may have a weaker magnetic field than the adjacent magnetic pole.

4. A core assembly for magnetizing a columnar permanent magnet for use in an electrostatic developing apparatus comprising:

a plurality of axially extending magnetic poles, said poles being circumferentially disposed so that the inner surfaces of the poles partially define a through-hole for receiving a magnet to be magnetized and are adapted to be arranged in close proximity to the outer surface of the magnet when it is disposed therein; and means for generating between the adjacent magnetic poles of the core assembly a magnetic field which has a flux distribution without an abrupt polarity inversion.

* * * * *